US006715189B2

(12) United States Patent
Osbon et al.

(10) Patent No.: US 6,715,189 B2
(45) Date of Patent: Apr. 6, 2004

(54) METHOD FOR PRODUCING A NONWOVEN FABRIC WITH ENHANCED CHARACTERISTICS

(75) Inventors: Robert Lindsay Osbon, Waterloo, SC (US); John Scott McDaniel, Greenville, SC (US)

(73) Assignee: Milliken & Company, Spartanburg, SC (US)

( * ) Notice: Subject to any disclaimer, the term of this patent is extended or adjusted under 35 U.S.C. 154(b) by 163 days.

(21) Appl. No.: 10/083,922

(22) Filed: Feb. 27, 2002

(65) Prior Publication Data

US 2003/0159260 A1 Aug. 28, 2003

(51) Int. Cl.[7] ..... D06C 29/00
(52) U.S. Cl. ..... 26/1; 28/167
(58) Field of Search ..... 26/167, 1, 18.5, 26/19, 20, 21; 28/167

(56) References Cited

U.S. PATENT DOCUMENTS

| | | | | | |
|---|---|---|---|---|---|
| 4,837,902 | A | | 6/1989 | Dischler | 26/1 |
| 4,918,795 | A | | 4/1990 | Dischler | 26/1 |
| 5,142,750 | A | * | 9/1992 | Dyer et al. | 26/29 R |
| 5,355,565 | A | * | 10/1994 | Baravian | 28/104 |
| 5,822,835 | A | | 10/1998 | Dischler | 28/167 |
| 5,899,785 | A | | 5/1999 | Groten et al. | 442/334 |
| 5,933,931 | A | * | 8/1999 | Greenway | 28/167 |
| 5,970,583 | A | | 10/1999 | Groten et al. | 19/296 |
| 6,178,607 | B1 | | 1/2001 | Dischler | 28/167 |
| 6,200,669 | B1 | | 3/2001 | Marmon et al. | 428/198 |

* cited by examiner

*Primary Examiner*—Danny Worrell
(74) *Attorney, Agent, or Firm*—Terry R. Moyer; Brenda D. Wentz

(57) ABSTRACT

This invention relates to specific, improved spun-bonded nonwoven fabrics comprised of continuous multi-component longitudinally splittable fibers. The resulting nonwoven fabrics exhibit enhanced flexibility, drape, softness, thickness, moisture absorption capacity, moisture vapor transmission rate, and cleanliness in comparison with other nonwovens of the same fiber construction. These improved aesthetic and performance characteristics permit expansion of high-strength nonwoven fabric materials into other markets and industries currently dominated by woven and knit fabrics that exhibit such properties themselves, but at high cost and requiring greater manufacturing complexity. Such enhanced fabrics are subjected to certain air impingement procedures, for instance through directing low-pressure gaseous fluids at high velocity to the surface of the targeted nonwoven fabric. Also encompassed within this invention is the method of treating such a specific nonwoven fabric with this air impingement procedure.

21 Claims, No Drawings

METHOD FOR PRODUCING A NONWOVEN FABRIC WITH ENHANCED CHARACTERISTICS

BACKGROUND OF THE INVENTION

This invention relates to specific, improved spun-bonded nonwoven fabrics comprised of continuous multi-component longitudinally splittable fibers. The resulting nonwoven fabrics exhibit enhanced flexibility, drape, softness, thickness, moisture absorption capacity, moisture vapor transmission rate, and cleanliness in comparison with other nonwovens of the same fiber construction. These improved aesthetic and performance characteristics permit expansion of high-strength nonwoven fabric materials into other markets and industries currently dominated by woven and knit fabrics that exhibit such properties themselves, but at high cost and requiring greater manufacturing complexity. Such enhanced fabrics are subjected to certain air impingement procedures, for instance through directing low-pressure gaseous fluids at high velocity to the surface of the targeted nonwoven fabric. Also encompassed within this invention is the method of treating such a specific nonwoven fabric with this air impingement procedure.

Nonwoven textile articles have historically possessed many desirable attributes that led to their use for many items of commerce, such as within air filters, furniture linings, and automotive parts, such as vehicle floorcoverings, side panels, and molded trunk linings. Such nonwovens have proven to be lightweight, inexpensive, and uncomplicated to manufacture, among various other advantages.

Recently, technological advances in the field of nonwovens, such as improved abrasion resistance and wash durability, have expanded the markets for such materials. For example, U.S. Pat. Nos. 5,899,785 and 5,970,583, both assigned to Firma Carl Freudenberg, describe a nonwoven lap of very fine continuous filament and the process for making such nonwoven lap using traditional nonwoven manufacturing techniques. Such references disclose, as important raw materials, spun-bonded composite, or multi-component, fibers that are longitudinally splittable by mechanical or chemical action. Furthermore, patentees indicate the ability to subject a nonwoven lap, or fabric, formed from such materials to high-pressure water jets (i.e., hydroentanglement). This further treatment causes the composite fibers (which are typically microdenier in size) to partially separate along their lengths and become entangled with one another, thereby imparting strength to the final product. As an example, Freudenberg currently commercializes at least one product, Evolon®, made by this process, and it is available in standard or point-bonded variations. (The standard variation has not been subjected to further bonding processes, such as point bonding. Point-bonding is the process of binding thermoplastic fibers into a nonwoven fabric by applying heat and pressure so that a discrete pattern of fiber bonds is formed.) Additionally, U.S. Pat. No. 6,200,669, assigned to Kimberly-Clark Worldwide, Inc., describes yet another process for fabricating spun-bonded nonwoven webs from continuous multi-component fibers that are longitudinally splittable by the process of hydroentanglement.

These manufacturing techniques permit efficient and inexpensive production of nonwoven fabrics having characteristics and properties, such as, for example, mechanical resistance, equal to those of woven or knitted fabrics. As a result, such nonwovens have penetrated markets, such as apparel, cleaning cloths, and artificial leather, which historically have been dominated by woven and knit products.

However, with the emergence of nonwovens into these new markets and increased consumer interest in such products, there has been a desire to produce fabrics with additional characteristics similar to those of woven or knitted fabrics. Some of these characteristics include increased flexibility, drape, and softness of the fabric. Historically, these attributes have been obtained subsequent to the fabric's finishing (i.e. after finishing processes which include, for example, dyeing, decorating, texturing, etc.) with some difficulty due to the fragile nature of the fabric and the ease of mark-off of any dyes, pigments, or other decorative accoutrements. Prior methods of fabric conditioning after finishing have included roughening of the finished product with textured rolls or pads, which may actually break a significant number of surface fibers. These methods, as mentioned above, may be destructive to the finished fabric because of such problems as undue weakening of the overall strength of the fabric and mark-off.

Additionally, other methods for conditioning include the use of chemicals, which can be expensive, detrimental to the environment, and irritating to the skin. Thus, a chemical-free process, which involves no contact with rough surfaces, is preferable in order to reduce or eliminate skin irritation and minimize damage to the surface of the fabric while providing optimal levels of softening and conditioning to the fabric. Commonly assigned U.S. Pat. Nos. 4,837,902, 4,918,785, 5,822,835, and 6,178,607 have identified techniques for conditioning textile webs, or fabrics, to change their aesthetic and performance qualities. Specifically, these patents disclose methods and equipment for projecting low pressure, high velocity streams of gaseous fluid against a fabric web in either the opposite or same direction substantially tangential to the web of fabric, thereby creating saw-tooth waves having small bending radii which travel down the fabric thereby breaking up, or weakening, some fiber-to-fiber bonds in the web so as to increase flexibility, drape, and softness of the fabric. An additional attribute imparted to the fabric treated by these processes of air impingement includes increased cleanliness of the fabric due to the removal of undesired fiber fly and other loose materials entrapped in the pile.

Thus, while nonwoven manufacturing technology has been identified which has allowed for the introduction of nonwoven textile fabrics into new market areas such as apparel, cleaning cloths, and artificial leather, consumer interest has spurred the need for further advances in the finishing of these fabrics in order to improve the look and feel of the fabric for emergence into additional markets and end-use products for apparel, napery, drapery, upholstery, cleaning cloths, and cleanrooms.

SUMMARY OF THE INVENTION

In light of the foregoing discussion, it is one object of the current invention to achieve a spun-bonded nonwoven fabric comprised of continuous multi-component splittable fibers, which has been mechanically modified to possess increased flexibility and drape.

A further object of the current invention is to achieve a spun-bonded nonwoven fabric comprised of continuous multi-component splittable fibers, which has been mechanically modified to possess increased softness and thickness.

It is also an object of the current invention is to achieve a spun-bonded nonwoven fabric comprised of continuous multi-component splittable fibers, which has been mechanically modified to possess increased moisture absorption capacity and moisture vapor transmission rate.

Another object of the current invention is to achieve a spun-bonded nonwoven fabric comprised of continuous multi-component splittable fibers, which has been mechanically modified to possess increased cleanliness due to the removal of loose materials trapped in the fabric.

A further object of the current invention is to achieve a spun-bonded nonwoven fabric comprised of continuous multi-component splittable fibers, which has been mechanically modified and that maintains its aesthetic appearance due to the finishing process having no physical contact with the surface of the fabric.

It is also an object of the current invention to achieve a method for mechanically modifying spun-bonded nonwoven fabrics comprised of continuous multi-component splittable fibers to impart increased flexibility, drape, softness, thickness, moisture absorption capacity, moisture vapor transmission rate, and cleanliness to the fabric.

Other objects, advantages, and features of the current invention will occur to those skilled in the art. Thus, while the invention will be described and disclosed in connection with certain preferred embodiments and procedures, such embodiments and procedures are not intended to limit the scope of the current invention. Rather, it is intended that all such alternative embodiments, procedures, and modifications are included within the scope and spirit of the disclosed invention and limited only by the appended claims and their equivalents.

DETAILED DESCRIPTION OF THE INVENTION

A spun-bonded nonwoven fabric comprised of continuous multi-component splittable fibers is provided that has been mechanically modified to achieve useful improvements in certain desired properties. U.S. Pat. Nos. 5,899,785 and 5,970,583, both incorporated herein by reference, describe one non-limiting embodiment of a starting nonwoven material and process for manufacturing the nonwoven lap, or fabric, to be mechanically modified by the previously mentioned air impingement process, thereby providing the inventive nonwoven fabrics. Typically, the nonwoven fabric is comprised of spun-bonded continuous multi-component filament fiber that has been, either partially or wholly, longitudinally split into its individual component fibers by exposure to mechanical or chemical means, such as high-pressure fluid jets. One potentially preferred non-limiting fabric composition generally comprises 65% polyester fiber and 35% nylon 6 or nylon 6,6 fiber, although other fabric compositions with varying percentages of different fiber types are within the scope of this invention. Acceptable fabrics comprise a majority of synthetic fiber, preferable all synthetic fiber, wherein the term "synthetic" is intended to include any type of fiber not available as a naturally base product. Thus, acceptable fibers include polyester, such as, for example, polyethylene terephthalate, polytriphenylene terephthalate, and polybutylene terephthalate; polyamide, such as nylon 6 and nylon 6,6, again, as merely examples; polyolefins, such as polypropylene, polyethylene, and the like; polyaramides, such as Kevlar®, polyurethanes; polylactic acid; and any combinations thereof.

The general process for manufacturing this nonwoven lap, or fabric, includes the steps of extrusion and spinning; drawing, cooling, and napping; and simultaneously or successively, bonding and consolidation. During the bonding and consolidation step, several actions occur: (i) the composite filaments are at least partially separated into their individual filaments by, for example, hydroentanglement with high-pressure water jets, (ii) the cohesion and mechanical resistance of the nonwoven lap, or fabric, may be increased, for example, by thermobonding the individual filament with the lower melting point by calendering with a smooth or engraved hot roller, and (iii) ultimately, the nonwoven fabric is dried by methods such as the above-mentioned calendering step, or alternatively, merely as an example, by passage through a hot-air tunnel.

The process for mechanically treating the nonwoven fabric, which is typically comprised of polyester and nylon composite fibers, is described in commonly assigned U.S. Pat. Nos. 4,837,902, 4,918,785, 5,822,835, and 6,178,607, which are incorporated herein by reference. These patents describe fabric conditioning processes that project low pressure, high velocity streams of gaseous fluid against the fabric web in various directions compared to the direction of fabric web flow substantially tangential to the web of the fabric, thereby creating saw-tooth waves having small bending radii which travel down the fabric thereby breaking up, or weakening, some fiber-to-fiber bonds in the web so as to increase flexibility, drape, and softness of the fabric. The streams of gaseous fluid may be directed against the fabric in the same direction as fabric web flow, opposite the direction of fabric web flow, simultaneously in both directions, or successively in both directions of fabric web flow. One opening, or a plurality of openings may deliver the streams of gaseous fluid. Generally, the fabric is exposed to a high velocity vibration technique. In relation to this invention, it has been realized, surprisingly, that such a treatment procedure imparts additional attributes to the target nonwoven fabric including increased fabric thickness, moisture absorption capacity, and moisture vapor transmission rate all for the benefit of allowing the expanding uses of such nonwoven materials.

It is contemplated that all these attributes generally result from the break-up of some of the fiber-to-fiber bonds in the nonwoven fabric web, as well as from the additional splitting of the composite fibers into their individual components. Such results are not generally available to the same degree with woven and knit fabrics. A further benefit resulting from this air impingement process is the increased cleanliness of the fabric in terms of residual, loose surface fibers retained thereon because the process ultimately loosens and removes fiber fly, lint, and other undesirable materials from the fabric. This feature is important for aesthetic reasons in most fabric applications, but it also has functional use in end-use products for cleanrooms where even the smallest particle of lint from a fabric can cause irreversible damage, for example, to highly delicate silicon wafers.

In one potentially preferred embodiment of the current invention, the air impingement treatment equipment is installed in-line with the nonwoven manufacturing process such that the nonwoven fabric is exposed to air impingement treatment following the hydroentanglement step of the nonwoven production process while the fabric is still wet. The nonwoven fabric is typically treated by air impingement on one side of the fabric, although it is contemplated to be within the scope of this invention that the fabric may be treated by air impingement on both sides of the fabric. Following treatment with air impingement, the wet fabric is then bonded and dried by processes described above, such as thermobonding the lower melting point filament. The fabric may then be dyed or printed and exposed to further finishing processes according to techniques known to those skilled in the art.

Another potentially preferred embodiment of the current invention involves exposing the nonwoven fabric to the air impingement process after the bonding and consolidation step of the production process. To this end, the air impingement process may be installed in-line with the nonwoven production process such that the fabric is treated immediately as it exits the production line, or it may be treated separately from the production line. In relation to this invention, it has been realized, unexpectedly, that the dyed fabric tends to exhibit a slightly lighter shade of color than a dyed nonwoven control fabric that is not treated by the air impingement process. Without being bound by theory, this suggests that the air impingement process opens up the dense fiber-to-fiber construction of the fabric and creates available space, which allows dyes to further penetrate to fibers deep within the treated dyed fabric. In contrast, the untreated dyed fabric likely has less available open space and less penetration of dye into the interior of the fabric leaving a higher concentration of dye on the surface of the fabric, thereby creating a fabric that is slightly darker in color.

A further potentially preferred embodiment of the current invention involves exposing the nonwoven fabric to the air impingement process after the fabric has been dyed, printed, sanforized, or further modified by finishing processes known to those skilled in the art.

An advantage of producing a nonwoven fabric according to the method described herein includes the consolidation of process steps by incorporating the air impingement process in-line with the nonwoven production process. Typically, manufacturers would likely incur cost savings by such consolidation of process steps, as well as through complexity reduction via simplified production layouts and organizations, as well as through reductions in required time allocation (e.g., by eliminating the need to take the fabric off the original production line, move it, and tie it into a separate line for air impingement treatment). However, it may be necessary, and is contemplated within the scope of the invention described herein, to treat the fabric by air impingement separate from the production line because further advantages may be gained, for example, by manufacturing the nonwoven fabric, treating it chemically to impart certain properties, dyeing the fabric, and then exposing the finished product to desired and unexpectedly beneficial air impingement.

A further advantage of the current invention is the flexibility of process step sequences and/or arrangements. For example, the fabric may be treated by air impingement: (i) during the nonwoven production process via an in-line arrangement; (ii) after the nonwoven production process either in-line or separate from the production process; (iii) before the fabric has been dyed, printed, or further modified by chemical or mechanical finishing processes; or (iv) after the fabric has been dyed, printed, or further modified by chemical or mechanical finishing processes. This advantageous flexibility permits a manufacturer to choose the process which best optimizes one of the many enhancements imparted to the nonwoven fabric for a particular end use, as well as to possibly determine the best configuration, from an efficiency perspective, for his own manufacturing operations and retain the ability to produce such beneficial inventive nonwoven fabrics.

Other advantages of producing a nonwoven fabric according to the method described herein include the many enhanced characteristics possessed by the fabric. These characteristics include increased flexibility, drape, softness, thickness, moisture absorption capacity, moisture vapor transmission rate, and cleanliness. Consumer interest has accelerated the need for nonwoven fabrics to possess these types of characteristics, which are similar to woven or knitted fabrics, for end uses in apparel, drapery, napery, upholstery, cleaning cloths, and cleanroom markets.

A further advantage of the nonwoven fabric produced according to the present invention is that is has application for use as an allergy barrier. This fabric is characterized by a highly dense construction due to the microdenier size of the individual fibers that have been split during the production process. The dense nature of this fabric allows it to act as a filter to small allergy causing materials. Other nonwoven fabrics used as allergy barriers are typically comprised of multiple layers of fabric and film laminated together for that purpose (e.g., as taught within U.S. Pat. No. 6,017,601) such that one layer provides a film barrier, while another layer provides textile-like properties. These laminated nonwoven allergy barriers generally exhibit short useful lives because they often delaminate after repeated use or wash cycles. Conversely, the fabric of the current invention may be ideal for use as an allergy barrier without requiring lamination to additional layers of fabric or film, thereby avoiding the aforementioned potentially deleterious delamination problem. For example, a single layer of this fabric may be exposed to the air impingement treatment process described herein to achieve a fabric having improved softness, drape, flexibility, etc. Accordingly, the resulting fabric may be ideal for use as an allergy barrier in bedding applications or any other applications where such allergy barriers are useful.

Another advantage of the nonwoven fabric produced according to the present invention is that it possess enhanced characteristics such as increased flexibility, drape, softness, thickness, moisture absorption capacity, moisture vapor transmission rate, and cleanliness, which are imparted to the fabric without the use of chemicals which may be expensive, irritating to the skin, and detrimental to the environment.

The following examples illustrate various embodiments of the present invention but are not intended to restrict the scope thereof.

All examples utilized spun-bonded nonwoven fabric comprised of continuous multi-component splittable fibers which have been exposed to the process of hydroentanglement with high-pressure water to cause the multi-component fibers to split, at least partially, along their length into individual polyester and nylon 6,6 fibers, according to processes described in the two Freudenberg patents earlier incorporated by reference. The fabric, known by its product name as Evolon®, was obtained from Firma Carl Freudenberg of Weinheim, Germany.

Some of the fabrics described in the examples below were tested using the Kawabata Evaluation System ("Kawabata System") installed at the Textile Testing Laboratory at Milliken Research Corporation in Spartanburg, S.C. The Kawabata System was developed by Dr. Sueo Kawabata, Professor of Polymer Chemistry at Kyoto University in Japan, as a scientific means to measure, in an objective and reproducible way, the "hand" of textile fabrics. This is achieved by measuring basic mechanical properties that have been correlated with aesthetic properties relating to hand (e.g. smoothness, fullness, stiffness, softness, flexibility, and crispness), using a set of four highly specialized measuring devices that were developed specifically for use with the Kawabata System. These devices are as follows:

Kawabata Tensile and Shear Tester (KES FB1)

Kawabata Pure Bending Tester (KES FB2)

Kawabata Compression Tester (KES FB3)

Kawabata Surface Tester (KES FB4)

KES FB1 through 3 are manufactured by the Kato Iron Works Col, Ltd., Div. of Instrumentation, Kyoto, Japan. KES FB4 (Kawabata Surface Tester) is manufactured by the Kato Tekko Co., Ltd., Div. of Instrumentation, Kyoto, Japan. Care was taken to avoid folding, wrinkling, stressing, or otherwise handling the samples in a way that would deform the sample. The fabrics were tested in their as-manufactured form (i.e. they had not undergone subsequent launderings.)

The Kawabata Pure Bending Tester (KES FB2) was the selected test performed on some of the fabric samples described in the examples below. The testing equipment was set up according to the instructions in the Kawabata Manual. The Kawabata Bending Tester was allowed to warm up for at least 15 minutes before being calibrated. The tester was set up as follows:

Sensitivity: 2 by 1

Sample Size: 8 inches by 8 inches

The bending test measures the resistive force encountered when a piece of fabric that is held or anchored in a line parallel to the warp or filling is bent in an arc. For purposes of this testing, the warp direction was determined to be the machine direction of the fabric (i.e., the direction in which the fabric entered and exited the production equipment as it was manufactured), and the fill direction was estimated to be perpendicular to the warp, or machine, direction of the fabric. The fabric is bent first in the direction of one side and then in the direction of the other side. This action produces a hysteresis curve since the resistive force is measured during bending and unbending in the direction of each side. The width of the fabric in the direction parallel to the bending axis affects the force. The test ultimately measures the bending momentum and bending curvature. The following quantities are directly measured:

X=curvature K [$cm^{-1}$]

Y=bending momentum [gf-cm]

The final hysteresis at a given K is the average of the corresponding hysteresis values for the forward and backward parts of the graph, i.e., at±K.

The formulas for calculating the bending quantities are given below:

L1=width [cm] of fabric in direction parallel to the bending axis the nominal value is 20 cm.

$$B = \frac{a' + b'}{2} \times \frac{1}{L1} \quad [\text{gf-cm}^2/\text{cm}]$$

where a and b have units of gf-cm/$cm^{-1}$ and where $$a' = \frac{a}{1.5 - 0.5}$$

is the slope of Upper Forward branch between K=0.5 and K=1.5

$$b' = \frac{b}{1.5 - 0.5}$$

is the slope of Lower Backward branch between K=−0.5 and K=−1.5

$$2HB05 = \frac{e + g}{2} \times \frac{1}{L1} \quad [\text{gf-cm/cm}]$$

where e and g have units of gf-cm $$2HB10 = \frac{c + d}{2} \times \frac{1}{L1} \quad [\text{gf-cm/cm}]$$

where c and d have units of gf-cm $$2HB15 = \frac{f + h}{2} \times \frac{1}{L1} \quad [\text{gf-cm/cm}]$$

where f and h have units of gf-cm

Bending Stiffness (B)—Mean bending stiffness per unit width [gf-$cm^2$/cm]. Lower value means a more supple hand.

Bending hysteresis (2HB05)—Mean width of bending hysteresis per unit width at K=0.5 $cm^{-1}$ [gf-cm/cm]. Lower value means the fabric recovers more completely from bending.

Bending hysteresis (2HB10)—Mean width of bending hysteresis per unit width at K=1.0 $cm^{-1}$ [gf-cm/cm]. Lower value means the fabric recovers more completely from bending.

Bending hysteresis (2HB15)—Mean width of bending hysteresis per unit width at K=1.5 $cm^{-1}$ [gf-cm/cm]. Lower value means the fabric recovers more completely from bending.

EXAMPLE 1

The following example shows treatment of the Evolon® fabric with the air impingement process in a laboratory setting.

Standard (rather than point-bonded) Evolon® fabric at 160 g/$m^2$ was subjected to a laboratory simulation of the air impingement process as described in the commonly assigned U.S. patents earlier incorporated by reference. Air pressure at 80 psi was delivered by one opening, or slot, to both sides of a piece of fabric, approximately 65 inches by 15 inches, for about 60 seconds. Four 8 inch by 8 inch samples (Samples A–D) were then cut from the treated fabric and tested using the Kawabata Pure Bending Tester. The warp direction was determined to be the machine direction of the fabric when it was manufactured, and the filling direction was estimated to be perpendicular to the warp, or machine direction. A ratio of fabric weight-to-Bending Stiffness (B) was also calculated, i.e. Ratio: Wt/(B). The results are shown in Tables 1A and 1B below.

TABLE 1A

Comparison of Kawabata Pure Bending Tester Results in Warp Direction

| | A | B | C | D | Avg | STD | ERR |
|---|---|---|---|---|---|---|---|
| | | Untreated Nonwoven Fabric 160 g/m$^2$ | | | | | |
| B | 2.392 | 2.704 | 2.528 | 2.856 | 2.620 | 0.203 | +/−0.322 |
| 2HB05 | 0.789 | 0.718 | 0.754 | 0.547 | 0.702 | 0.107 | +/−0.171 |
| 2HB10 | 1.107 | 1.160 | 1.163 | 1.085 | 1.129 | 0.039 | +/−0.062 |
| 2HB15 | 1.087 | 1.169 | 1.140 | 1.175 | 1.143 | 0.040 | +/−0.064 |
| Ratio: Wt/(B) | 66.9 | 59.2 | 63.3 | 56.0 | 61.1 | | |
| | | Treated Nonwoven Fabric 160 g/m$^2$ | | | | | |
| B | 0.636 | 0.700 | 0.855 | 0.631 | 0.706 | 0.105 | +/−0.166 |
| 2HB05 | 0.324 | 0.486 | 0.431 | 0.415 | 0.414 | 0.067 | +/−0.107 |
| 2HB10 | 0.411 | 0.539 | 0.565 | 0.483 | 0.500 | 0.068 | +/−0.108 |
| 2HB15 | 0.441 | 0.531 | 0.584 | 0.474 | 0.508 | 0.063 | +/−0.100 |
| Ratio: Wt/(B) | 251.6 | 228.6 | 187.1 | 253.6 | 226.6 | | |

TABLE 1B

Comparison of Kawabata Pure Bending Tester Results in Filling Direction

| | A | B | C | D | Avg | STD | ERR |
|---|---|---|---|---|---|---|---|
| | | Untreated Nonwoven Fabric 160 g/m$^2$ | | | | | |
| B | 1.150 | 1.257 | 1.557 | 1.724 | 1.422 | 0.265 | +/−0.421 |
| 2HB05 | 0.310 | 0.338 | 0.433 | 0.330 | 0.353 | 0.055 | +/−0.087 |
| 2HB10 | 0.454 | 0.507 | 0.633 | 0.602 | 0.549 | 0.083 | +/−0.132 |
| 2HB15 | 0.535 | 0.541 | 0.649 | 0.697 | 0.606 | 0.080 | +/−0.128 |
| Ratio: Wt/(B) | 139.1 | 127.3 | 102.8 | 92.8 | 112.5 | | |
| | | Treated Nonwoven Fabric 160 g/m$^2$ | | | | | |
| B | 0.436 | 0.323 | 0.414 | 0.341 | 0.379 | 0.055 | +/−0.087 |
| 2HB05 | 0.272 | 0.209 | 0.247 | 0.253 | 0.245 | 0.026 | +/−0.042 |
| 2HB10 | 0.308 | 0.250 | 0.290 | 0.272 | 0.280 | 0.025 | +/−0.039 |
| 2HB15 | 0.328 | 0.245 | 0.299 | 0.268 | 0.285 | 0.036 | +/−0.058 |
| Ratio: Wt/(B) | 367.0 | 495.4 | 386.5 | 469.2 | 422.2 | | |

Several observations can be made regarding the data in Tables 1A and 1B. First, the treated samples exhibit lower Bending Stiffness (B) and Bending Hysteresis (2HB05-15) than the untreated, or greige, samples for both the warp and fill estimated directions. This suggests that the treated fabric is, overall, more supple and recovers more quickly from bending than the untreated samples. Additionally, the ratio of fabric weight-to-Bending Stiffness is greater for all of the treated samples when compared to the untreated samples. The ratio for the treated samples is about 187 or greater. These results demonstrate the effectiveness of treating the spun-bonded nonwoven fabric to improve the fabric's flexibility and drape, in comparison to the untreated samples, which are important attributes for end-use products such as apparel, napery, drapery, and upholstery.

EXAMPLE 2

Example 1 was repeated, and the fabric was tested for thickness. The thickness of the fabric was determined using a Thwing-Albert VIR Electronic Thickness Tester (Model No. 89-II-S) according to ASTM D 1777-96.

The untreated greige fabric measured 23.63 mils in thickness, while the treated greige fabric measured 28.98 mils in thickness. These results suggest that by treating both sides of the 160 g/m$^2$ fabric with low-pressure air at high velocity, the thickness of the fabric may be increased by about 20 percent. This increase in fabric thickness is likely due to the loosening of composite fiber bundles in the nonwoven fabric by breaking, or weakening, some of the bonds formed during the bonding and consolidation step of the nonwoven production process. Furthermore, the increase may result, at least partially, from further splitting of the composite fibers into their individual fibers. Both of these actions result in the opening up of the fabric by creating free space between fiber bundles and between individual fibers. This increased thickness of the treated fabric has resulted in a fabric with microfiber-like softness, which is desirable in end-use products such as apparel, napery, drapery, and upholstery. Additionally, it is contemplated that, depending on the initial fabric weight, the increase in fabric thickness may vary slightly. For example, treating both sides of a lightweight fabric (i.e., a fabric having a fabric weight of less than about 160 g/m$^2$) with the air impingement process may result in about a 15 percent thickness increase that is beneficial for imparting improved softness, or hand, to the fabric. Furthermore, treating the same lightweight fabric with the air impingement process on only one side of the fabric may result in about a 10 percent increase in fabric thickness, which still provides beneficial aesthetic and performance characteristics to the fabric.

EXAMPLE 3

Example 1 was repeated, and the fabric was tested for absorption capacity. The phrase "absorption capacity" is intended to describe the capacity of the fabric to absorb water. The capacity is measured as milliliters of water per gram of fabric. Four 7 inch by 7 inch fabric samples were created whereby two of the samples were untreated (Samples A and B) and two of the samples were treated by air impingement (Samples C and D). The samples were weighed in their dry state and then placed in a beaker of water and permitted to absorb as much water as possible. The samples were then removed from the water and allowed to drip at an angle for 30 seconds. The samples were then re-weighed. The results are shown in Table 2 below.

TABLE 2

Absorption Capacity of Treated and Untreated Nonwoven Fabric

| Sample | Absorption Capacity (ml/g) |
|---|---|
| A - Untreated | 3.47 |
| B - Untreated | 3.38 |
| Untreated Avg. | 3.43 |
| C - Treated | 4.47 |
| D - Treated | 4.45 |
| Treated Avg. | 4.46 |

Table 2 shows that treating the nonwoven fabric with the air impingement process results in a 30 percent increase in absorption capacity of the fabric. It is contemplated that an absorption capacity of about 3.75 ml/g or greater (an increase of approximately 10 percent or more) may result in some benefit for enhancing the fabric's absorption properties. This enhancement of the fabric is useful in end-use products such as sports apparel, cleaning cloths, napery, and any other applications where moisture transmission is an important feature.

EXAMPLE 4

Example 1 was repeated, except that the fabric was jet-dyed after the air impingement treatment. The fabric was dyed using disperse dyes for 30 minutes at 130 degrees C. The jet-dye was cooled to 50 degrees C. and then the fabric was rinsed twice with water. The fabric was hung to dry in an oven for 5 minutes at 350 degrees F. One 8 inch by 8 inch sample of treated and untreated fabric was then tested using the kawabata Pure Bending Tester (indicated as "A"). The fabric was also tested for shade, or color, variation using a Lab Scan XE manufactured by Hunter Labs., such that "L" indicates the whiteness of the fabric, "A" indicates the tan to green color of the fabric, and "B" indicates the yellowness of the fabric. The results are shown in Tables 3A, 3B, and 3C below.

TABLE 3A

Comparison of Kawabata Pure Bending Tester Results in Warp Direction

| | A |
|---|---|
| Untreated Nonwoven Fabric 160 g/m$^2$ | |
| B | 0.154 |
| 2HB05 | 0.131 |
| 2HB10 | 0.124 |
| 2HB15 | 0.117 |

TABLE 3A-continued

Comparison of Kawabata Pure Bending Tester Results in Warp Direction

| | A |
|---|---|
| Treated Nonwoven Fabric 160 g/m$^2$ | |
| B | 0.110 |
| 2HB05 | 0.070 |
| 2HB10 | 0.066 |
| 2HB15 | 0.082 |

TABLE 3B

Comparison of Kawabata Pure Bending Tester Results in Filling Direction

| | A |
|---|---|
| Untreated Nonwoven Fabric 160 g/m$^2$ | |
| B | 0.173 |
| 2HB05 | 0.088 |
| 2HB10 | 0.102 |
| 2HB15 | 0.094 |
| Treated Nonwoven Fabric 160 g/m$^2$ | |
| B | 0.070 |
| 2HB05 | 0.094 |
| 2HB10 | 0.076 |
| 2HB15 | 0.070 |

TABLE 3C

Comparison of LAB Readings for Color Variation

| Sample | L* | A* | B* |
|---|---|---|---|
| Untreated | 74.70 | 7.39 | 33.68 |
| Treated | 75.86 | 8.56 | 36.21 |

Several observations can be made regarding the data in Tables 3A, 3B, and 3C. First, the treated dyed samples exhibit lower Bending Stiffness (B) and Bending Hysteresis (2HB05-15) than the untreated, dyed samples for both the warp and fill estimated directions. This indicates that the treated dyed fabric is, overall, more supple and recovers more quickly from bending than the untreated, dyed samples. These results demonstrate that exposing the fabric to the air impingement process before the fabric is dyed is an effectiveness procedure to improve the fabric's flexibility and drape, such that subsequent dyeing of the fabric did not negate these improvements. Furthermore, the results shown in Table 3C indicate that the treated dyed sample is lighter in color than the untreated dyed sample. This suggests that the air impingement process opens up the dense fiber-to-fiber construction of the fabric and creates available space, which allows the dye to further penetrate to fibers deep within the treated dyed fabric. As a result, it is likely that there is a decrease in the difference of dye concentration on the exterior fibers of the treated fabric and the dye concentration on the interior fibers of the treated fabric. Accordingly, it is likely that the fabric is more uniformly dyed. In contrast, the untreated dyed fabric likely has less available open space and therefore less penetration of dye into the interior of the fabric leaving a higher concentration of dye on the surface of the fabric, thereby creating a fabric that is slightly darker in color as noted by its exterior appearance. These noteworthy features of the treated dyed fabric suggest the usefulness of installing an air impingement finishing process in-line with the spun-bonded nonwoven production process because the benefits of air impingement are not lost after dyeing. Typically, this process arrangement would be both cost and time effective in manufacturing spun-bonded nonwoven fabrics comprised of multi-component splittable fibers with improved flexibility, drape, softness, thickness, moisture absorption capacity, moisture vapor transmission rate, and cleanliness.

EXAMPLE 5

Point-bonded Evolon® at 100 g/m$^2$ was tested for Bending Stiffness (B) using the Kawabata Pure Bending Tester. Two untreated samples (Sample A and B) and four samples treated with the air impingement process as described in Example 1 (Sample C, D, E, and F) were tested in both the warp and filling direction. Again, the warp direction is determined to be the machine direction, while the filling direction is estimated to be perpendicular to the warp, or machine direction. A ratio of fabric weight-to-Bending Stiffness (B) was also calculated, i.e. Ratio: Wt/(B). The results are shown in Table 4 below.

TABLE 4

Kawabata Bending Stiffness for Treated and Untreated Fabric

| | Bending Stiffness (B) | | Ratio: Wt/(B) | |
|---|---|---|---|---|
| | Warp | Filling | Warp | Filling |
| Untreated | | | | |
| Sample A | 0.490 | 1.154 | 204.1 | 86.7 |
| Sample B | 0.707 | 1.714 | 141.4 | 58.3 |
| Average | 0.599 | 1.434 | 166.9 | 69.7 |
| Treated | | | | |
| Sample C | 0.147 | 0.103 | 680.3 | 970.9 |
| Sample D | 0.142 | 0.091 | 704.2 | 1098.9 |
| Sample E | 0.099 | 0.082 | 1010.1 | 1219.5 |
| Sample F | 0.110 | 0.098 | 909.1 | 1020.4 |
| Average | 0.125 | 0.094 | 800.0 | 1063.8 |

Similar to Tables 1A and 1B, the treated samples shown in Table 4 above exhibit lower Bending Stiffness (B) than the untreated samples for both the warp and fill estimated directions which indicates that the treated fabric is, overall, more supple and than the untreated samples. Additionally, the fabric weight-to-Bending Stiffness ratio of all of the treated samples is greater than the ratio for the untreated samples. The data shows that the fabric weight-to-Bending Stiffness ratio for the treated samples is about 187 or greater, as shown in Example 1, but, furthermore, the ratio shown herein for this example is about 680 or greater. These results demonstrate the effectiveness of treating the spun-bonded nonwoven fabric to improve the fabric's flexibility and drape, which are important attributes for end-use products such as apparel, napery, drapery, and upholstery.

EXAMPLE 6

Point-bonded Evolon® at 100 g/m$^2$ was tested for Moisture Vapor Transmission Rate according to ASTM E96. Two untreated samples (Sample A and B) and two samples treated with the air impingement process as described in Example 1 (Sample C and D) were placed over a mason jar and secured with the ring portion of the mason jar lid. The mason jar, containing 330 ml of water, was weighed prior to a 24-hour test period and was then re-weighed after the 24-hour test period. The difference in weight of the jar, in combination with the size of fabric that covered the opening of the jar, determined how much water was transmitted through the fabric over the 24-hour test period. The results are shown in Table 5 below.

TABLE 5

Comparison of Moisture Vapor Transmission Rate

| | Moisture Vapor Transmission Rate (g/m$^2$) |
|---|---|
| Untreated | |
| Sample A | 616.74 |
| Sample B | 638.76 |
| Average | 627.75 |
| Treated | |
| Sample C | 726.87 |
| Sample D | 770.39 |
| Average | 748.63 |

Table 5 shows that treating the nonwoven fabric with the air impingement process results in a 19 percent increase in moisture vapor transmission rate of the fabric. It is contemplated that a moisture vapor transmission rate of about 675 g/m$^2$ or greater (an increase of approximately 8 percent or more) may result in some benefit for enhancing the fabric's moisture transmission properties. This enhancement of the fabric is useful in end-use products such as sports apparel, cleaning cloths, napery, and any other applications where moisture transmission is an important feature.

The above description and examples show the unexpected and beneficial flexibility, drape, softness, thickness, moisture absorption capacity, moisture vapor transmission rate, and cleanliness properties provided by the inventive spun-bonded nonwoven fabrics comprised of continuous multi-component splittable fibers. These benefits are achieved via a chemical-free process that mechanically modifies the surface of the fabric without actually contacting the surface of the fabric, in order to reduce or eliminate skin irritation and minimize damage to the surface of the fabric. Accordingly, this invention provides expanded utility within previously unavailable markets such that the fabric of the invention may be incorporated into articles of apparel, bedding, residential upholstery, commercial upholstery, automotive upholstery, napery, drapery, residential and commercial cleaning cloths, cleanroom items, allergy barriers, and any other article wherein it is desirable to manufacture an end-use product with these heretofore unavailable beneficial aesthetic and performance characteristics.

These and other modifications and variations to the present invention may be practiced by those of ordinary skill in the art, without departing from the spirit and scope of the present invention. Furthermore, those of ordinary skill in the art will appreciate that the foregoing description is by way of example only, and is not intended to limit the scope of the invention described in the appended claims.

We claim:

1. A method for providing a spun-bonded nonwoven fabric comprised of continuous multi-component fibers that are at least partially split along their length and that exhibits improved aesthetic and performance characteristics, the method comprising the sequential steps of:

(a) providing a wet, hydroentangled, spun-bonded nonwoven fabric comprised of continuous multi-component fibers which have been at least partially split along their length;

(b) subjecting the spun-bonded nonwoven fabric to an air impingement surface treatment;

(c) drying the treated fabric; and (d) printing, dyeing, or further treating the spun-bonded nonwoven fabric with a face-finishing process.

2. The method of claim 1, wherein the continuous multi-component fibers are comprised of fibers selected from the group consisting of polyester, polyamide, polyolefin, polyacrylic, polyaramide, polyurethane, polylactic acid, and combinations thereof.

3. The method of claim 2, wherein the continuous multi-component fibers are comprised of polyamide and polyester, wherein the polyester is selected from the group consisting of polyethylene terephthalate, polytriphenylene terephthalate, polybutylene terephthalate, and combinations thereof, and wherein the polyamide is selected from the group consisting of nylon 6, nylon 6,6, and combinations thereof.

4. The method of claim 3, wherein the continuous multi-component fibers are comprised of polyethylene terephthalate and nylon 6.6.

5. The method of claim 4, wherein the continuous multi-component fibers are comprised of polyethylene terephthalate and nylon 6,6, wherein polyethylene terephthalate comprises approximately 65% of the continuous multi-component fibers, and wherein nylon 6,6 comprises approximately 35% of the continuous multi-component fibers.

6. The method of claim 1, wherein the improved aesthetic and performance characteristics are selected from the group consisting of improved flexibility, drape, softness, thickness, moisture absorption capacity, moisture vapor transmission rate, cleanliness, and combinations thereof.

7. The product of the method of claim 1.

8. A method for providing a spun-bonded nonwoven fabric comprised of continuous multi-component fibers that are at least partially split along their length and that exhibits improved aesthetic and performance characteristics, the method comprising the sequential steps of:

(a) providing a spun-bonded nonwoven fabric comprised of continuous multi-component fibers which have been at least partially split along their length;

(b) dyeing or printing the spun-bonded nonwoven fabric;

(c) subjecting the spun-bonded nonwoven fabric to an air impingement surface treatment to create a treated spun-bonded nonwoven fabric exhibiting improved aesthetic and performance characteristics; and (d) further printing, dyeing, or treating the spun-bonded nonwoven fabric with a face-finishing process.

9. The method of claim 8, wherein the continuous multi-component fibers are comprised of fibers selected from the group consisting of polyester, polyamide, polyolefin, polyacrylic, polyaramide, polyurethane, polylactic acid, and combinations thereof.

10. The method of claim 9, wherein the continuous multi-component fibers are comprised of polyamide and polyester, wherein the polyester is selected from the group consisting of polyethylene terephthalate, polytriphenylene terephthalate, polybutylene terephthalate, and combinations thereof, and wherein the polyamide is selected from the group consisting of nylon 6, nylon 6,6, and combinations thereof.

11. The method of claim 10, wherein the continuous multi-component fibers are comprised of polyethylene terephthalate and nylon 6,6.

12. The method of claim 11, wherein the continuous multi-component fibers are comprised of polyethylene terephthalate and nylon 6,6, wherein polyethylene terephthalate comprises approximately 65% of the continuous multi-component fibers, and wherein nylon 6,6 comprises approximately 35% of the continuous multi-component fibers.

13. The method of claim 8, wherein the improved aesthetic and performance characteristics are selected from the group consisting of improved flexibility, drape, softness, thickness, moisture absorption capacity, moisture vapor transmission rate, cleanliness, and combinations thereof.

14. The product of the method of claim 8.

15. A method for providing a spun-bonded nonwoven fabric comprised of continuous multi-component fibers that are at least partially split along their length and that exhibits improved aesthetic and performance characteristics, the method comprising the sequential steps of:

(a) providing a spun-bonded nonwoven fabric comprised of continuous multi-component fibers which have been at least partially longitudinally split along their length;

(b) dyeing or printing the spun-bonded nonwoven fabric;

(c) subjecting the spun-bonded nonwoven fabric to an air impingement surface treatment to create a treated spun-bonded nonwoven fabric exhibiting a fabric weight-to-Bending Stiffness ratio of about 187 or greater, wherein the Bending Stiffness is measured by the Kawabata Pure Bending Tester (KES FB2); and (d) further printing, dyeing, or treating the spun-bonded nonwoven fabric with a face-finishing process.

16. The method of claim 15, wherein the continuous multi-component fibers are comprised of fibers selected from the group consisting of polyester, polyamide, polyolefin, polyacrylic, polyaramide, polyurethane, polylactic acid, and combinations thereof.

17. The method of claim 16, wherein the continuous multi-component fibers are comprised of polyamide and polyester, wherein the polyester is selected from the group consisting of polyethylene terephthalate, polytriphenylene terephthalate, polybutylene terephthalate, and combinations thereof, and wherein the polyamide is selected from the group consisting of nylon 6, nylon 6,6, and combinations thereof.

18. The method of claim 17, wherein the continuous multi-component fibers are comprised of polyethylene terephthalate and nylon 6,6.

19. The method of claim 18, wherein the continuous multi-component fibers are comprised of polyethylene terephthalate and nylon 6,6, wherein polyethylene terephthalate comprises approximately 65% of the continuous multi-component fibers, and wherein nylon 6,6 comprises approximately 35% of the continuous multi-component fibers.

20. The method of claim 15, wherein the improved aesthetic and performance characteristics are selected from the group consisting of improved flexibility, drape, softness, thickness, moisture absorption capacity, moisture vapor transmission rate, cleanliness, and combinations thereof.

21. The product of the method of claim 15.

* * * * *